US006022662A

United States Patent [19]

Matsumura et al.

[11] Patent Number: 6,022,662

[45] Date of Patent: Feb. 8, 2000

[54] TONER FOR DEVELOPING ELECTROSTATIC IMAGES, METHOD OF PRODUCING TONER FOR DEVELOPING ELECTROSTATIC IMAGES, ELECTROSTATIC IMAGE DEVELOPER

[75] Inventors: Yasuo Matsumura; Manabu Serizawa; Masaaki Suwabe; Shuji Sato; Yasuo Kadokura; Hisao Morijiri; Takeshi Shoji; Takahiro Mizuguchi, all of Minami-Ashigara, Japan

[73] Assignee: Fuji Xerox Co., Ltd., Tokyo, Japan

[21] Appl. No.: 09/063,349

[22] Filed: Apr. 21, 1998

[30] Foreign Application Priority Data

Apr. 30, 1997 [JP] Japan ..... 9-112615

[51] Int. Cl.[7] ..... G03G 9/87

[52] U.S. Cl. ..... 430/111; 430/137

[58] Field of Search ..... 430/137, 111

[56] References Cited

U.S. PATENT DOCUMENTS 5,290,654 3/1994 Sacripante et al. ..... 430/137
5,683,847 11/1997 Patel et al. ..... 430/137

FOREIGN PATENT DOCUMENTS 63-282752 11/1988 Japan .
6-250439 9/1994 Japan .

*Primary Examiner*—John Goodrow
*Attorney, Agent, or Firm*—Oliff & Berridge, PLC

[57] ABSTRACT

Disclosed is toner for developing an electrostatic image, which toner has a volume average particle size distribution index (GSDv) of 1.3 or less, and a ratio of the volume average particle size distribution index (GSDv) to a number average particle size distribution index (GSDp), i.e., (GSDv/GSDp), of 0.95 or more. A method suited for producing the toner for developing an electrostatic image comprises the steps of producing a dispersion liquid of flocculated particles by forming the flocculated particles in a dispersion liquid containing at least resin particles dispersed therein, forming adhered particles by admixing a liquid dispersion comprising fine particles dispersed therein with the dispersion liquid comprising the flocculated particles so that the fine particles adhere to the flocculated particles, and forming toner particles by fusing the adhered particles upon heating. This method for producing the toner for developing an electrostatic image provides the toner excellent in chargeability and having a long life.

15 Claims, 2 Drawing Sheets

FLAT PLATE TYPE

FULL ZONE TYPE

MAX BLEND TYPE

TONER FOR DEVELOPING ELECTROSTATIC IMAGES, METHOD OF PRODUCING TONER FOR DEVELOPING ELECTROSTATIC IMAGES, ELECTROSTATIC IMAGE DEVELOPER

BACKGROUND OF THE INVENTION

1. Field of the Invention

The present invention relates to toner for developing an electrostatic charge image which has excellent characteristics including chargeability and is suitable for use in the image formation in such application as electrophotography, a method for efficiently producing the toner, the toner which is produced by the method, and a developing agent for an electrostatic image produced by using the toner and a method for forming an image by using the toner.

2. Description of the Related Art

A method in which image information is visualized via an electrostatic image as in electrophotography is widely used currently in various fields. The general electrophotography method consists of the steps of forming an electrostatic image on a photorecepter after charging and exposure, developing the electrostatic image by use of a developer containing toner particles, and visualizing the developed image via transfer and fixation.

As is generally known, there are two types of the developer, that is, a two-component developer which comprises toner particles and carrier particles, and a one-component developer which comprises either magnetic toner particles or non-magnetic toner particles. The toner particles of these developers are usually prepared by a blending/pulverizing process. The blending/pulverizing process comprises the steps of melt-blending a thermoplastic resin or the like with a pigment, a charge controller and a release agent such as a wax, pulverizing the resulting product after cooling, and sieving the pulverized product to obtain desired toner particles. If necessary, for the purpose of improving the properties such as fluidity and cleanability of the thus prepared toner particles, inorganic and/or organic particles are added to the surface to the toner fine particles.

Usually, the shapes of the toner particles prepared in the above-mentioned blending/pulverizing process are irregular and the surface compositions of the toner particles are not uniform. The shapes and surface compositions of the toner particles vary subtly depending on the pulverizability of the materials and the pulverizing conditions. However, it is difficult to control intentionally the shapes and surface compositions of the toner particles within a desired range. Furthermore, if the materials of the toner particles are particularly easy to pulverize, it often occurs that the toner particles are further finely pulverized in a developing apparatus by a mechanical force such as a shearing force and that the shapes of the toner particles change. Accordingly, a problem to be encountered in the case of the two-component developer is prompted deterioration of the chargeability of the developer due to tenacious adhesion of the fine toner particles to the carrier surface, while problems to be encountered in the case of the one-component developer are, for example, the broadening of the particle size distribution accompanied by the dissipation of the fine toner particles, and the decline in quality of image as a result of the deterioration in developing performance of the toner due to the variation of the shapes of the toner.

Further, if the shapes of the toner particles are irregular, a sufficient fluidity cannot be obtained even if a fluidity aid is added. The fluidity decreases with the passage of time because a mechanical force such as a shearing force causes the fluidity aid particles to move to dents in the toner particles to be embedded therein. Consequently, the qualities such as developability, transferability and cleanability become worse. In addition, if such toner particles are recovered by a cleaning treatment, restored to the developing apparatus, and recycled, the quality of the obtained image tends to be inferior. If the amount of the fluidity aid is increased in order to prevent the above-mentioned problems, new problems will be, for example, the generation of black spots at the photorecepter and the dissipation of the particles of the fluidity aid.

Meanwhile, if the toner particles contain a release agent such as a wax, the release agent is exposed on the surface of the toner particles according to the combination of the release agent and a thermoplastic resin. In particular, if the toner particles consist of a resin, whose elasticity is arised by adding a polymer component and which is somewhat difficult to be pulverized, and a fragile wax such as polyethylene, a significant proportion of the polyethylene is exposed on the surface of the toner particles. Although these toner particles are advantageous in terms of release in the fixing process and removing the untransferred toner from the photorecepter, a mechanical force such as a shearing force inside the developing apparatus causes the polyethylene to separate from the toner particles and to migrate easily to such members as developing rolls, a photorecepter and carriers. Consequently, the contamination of these members lowers the reliability of the developer.

Because of this background, recently, an emulsion polymerization/flocculation process has been proposed as a method for producing toner particles whose shapes and surface compositions are intentionally controlled. The emulsion polymerization/flocculation process comprises the steps of preparing a resin dispersion liquid by an emulsion polymerization on the one hand, preparing a colorant dispersion liquid comprising a solvent and a colorant dispersed therein on the other hand, blending the two dispersion liquids to prepare flocculated particles having a particle size corresponding to the toner particle diameter, and then heating the blend to fuse the resin and the colorant to obtain toner particles. According to the emulsion polymerization/flocculation process, it is possible to control the shapes of the toner particles at will from an irregular shape to a sphere by selecting the heating temperatures.

In the emulsion polymerization/flocculation process, however, it is difficult to control intentionally the structure and the composition of the surface of the toner particles, because the composition in the region ranging from toner particle interior to the particle surface is made uniform by the fusion of the flocculated particles in a uniformly blended state. If the flocculated particles contain a release agent, the release agent is localized on the surface of the toner after fusion, which may lead to a filming phenomenon and the embedding of an external additive for improving fluidity into the toner particle interior.

In an electrophotographic process, in order to maintain and exhibit the quality of toner in a stable manner, it is necessary to inhibit the exposure of the release agent on the surface of toner particles, to increase the surface hardness of the toner particles and to increase the surface eveness of toner particles. Despite of the possible problems ascribable to the release agent exposed on the surface of toner particles, from the viewpoint of the toner quality at fixing process, it is desirable that the release agent be localized in the vicinity of the surface of toner particles.

Recently, because of a rise in demand for a high-quality image, especially for a high-quality color image, the diameter of the toner particles is remarkably reduced in order to perform a high-precision image. However, even if the particle sizes of conventional toner, whose particle distribution is too broad, are simply reduced, it is difficult to achieve a high-quality image and a high reliability simultaneously, because serious problems such as contamination of developing rolls, electrically charging rolls, electrically charging blades, photorecepter, carriers, and the like as well as dissipation of toner particles are caused by the toner particles having diameter in shorter regions of the particle size distribution. Further, if the toner particles having such a broad particle distribution are used in a system comprising means for cleaning, for recycling the toner, and the like, the reliability of the system is poor. In order to achieve a high-quality image and a high reliability simultaneously, it is necessary to narrow the width of the particle size distribution and to reduce the particle sizes.

SUMMARY OF THE INVENTION

Accordingly, the present invention intends to overcome the problems of prior art and to achieve the following objectives. That is, in the present invention, the structure and the composition in the region ranging from the surface to the interior of toner particle are controlled in order to achieve the following objectives:

1. To provide toner for developing an electrostatic image which is superior in various characteristics such as chargeability, developability, transferability, fixability and cleanability and particularly in chargeability as well as to provide a developer using the toner;
2. To provide toner for developing an electrostatic image which is capable of maintaining and exhibiting the above-mentioned characteristics and particularly the chargeability without being influenced by environmental conditions and which has a high reliability as well as to provide a developer using the toner;
3. To provide toner for developing an electrostatic image suited for a two-component developer which has a high transfer efficiency, can form an image with a small amount and yet has a long life;
4. To provide an easy and simple method for producing toner for developing an electrostatic image which is superior in the above-mentioned characteristics;
5. To provide an easy and simple method for forming a full-color image with a high-quality and high reliability;
6. To provide a method for forming an image which ensures a high-quality image in a system without means for cleaning, namely, a cleaner-less system; and
7. To provide a method for forming an image which is highly suited even to a toner-recycle system reusing the toner recovered from a cleaner and which ensures a high-quality image.

After intensive studies, we have invented the following in order to achieve the objectives stated above.

One of the embodiments of the present invention is toner for developing an electrostatic image, said toner having a volume average particle size distribution index (GSDv) of 1.3 or less, and a ratio of the volume average particle size distribution index (GSDv) to a number average particle size distribution index (GSDp), i.e., (GSDv/GSDp), of 0.95 or more.

Another embodiment of the present invention is a method for producing toner for developing an electrostatic image, the method comprising the steps of preparing a dispersion liquid of flocculated particles by forming the flocculated particles in a dispersion liquid containing at least resin particles dispersed therein, forming adhered particles by admixing a liquid dispersion comprising fine particles dispersed therein with the dispersion liquid of the flocculated particles so that the fine particles adhere to the flocculated particles, and forming toner particles by heating the adhered particles fuse into the flocculated particles, wherein the toner particles formed thus obtained has a volume average particle size distribution index (GSDv) of 1.3 or less, and a ratio of the volume average particle size distribution index (GSDv) to a number average particle size distribution index (GSDP), i.e., (GSDv/GSDp), of 0.95 or more.

BRIEF DESCRIPTIONS OF THE DRAWINGS

DESCRIPTION OF THE PREFERRED EMBODIMENTS

Figure 1:
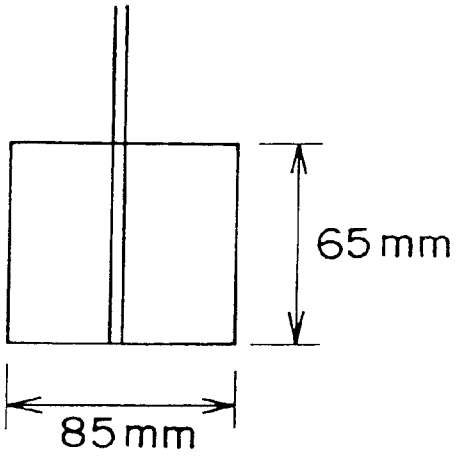
FIG. 1 is a diagram illustrating a single-flat plate blade as an example of a stirring means.

A Toner for Developing an Electrostatic Image

The particle size distribution of the toner for developing an electrostatic image according to the present invention is specified as follows. That is, the toner has a volume average particle size distribution index (GSDv), and a ratio of the volume average particle size distribution index (GSDv) to a number average particle size distribution index (GSDp), i.e., (GSDv/GSDp), given below.

These volume average particle size distribution index (GSDv) and number average particle size distribution index (GSDp) can be approximately expressed by using D16% and D84% in cumulative distribution, wherein the volume average particle size distribution index (GSDv) is expressed as $(\text{volume D84\%/volume D16\%})^{0.5}$ and the number average particle size distribution index (GSDp) is expressed as $(\text{number D84\%/number D16\%})^{0.5}$.

A Particle size distribution is measured by use of an instrument such as Coulter Counter TAII (manufactured by Nikkaki Co., Ltd.) or Multisizer II (manufactured by Nikkaki Co., Ltd.). The volume average and the number average distribution, respectively are plotted as a function of the divided regions (channels) from the side of small particle size. The particle diameters at which a cumulative percentage of 16% are attained are defined as volume D16% and number D16%, respectively, the particle diameters at which a cumulative percentage of 50% are attained are defined as volume D50% and number D50%, respectively, and the particle diameters at which a cumulative percentage of 84% are attained are defined as volume D84% and number D84%, respectively. The aforementioned volume average particle size distribution index (GSDv) and the number average particle size distribution index (GSDp) are calculated by using the above-mentioned D16% and D84% in the cumulative distribution.

The volume average particle size distribution index (GSDv) of the toner for developing an electrostatic image according to the present invention needs to be 1.3 or less, and is preferably 1.25 or less.

In addition to the above-mentioned ranges, a preferable range of the volume average particle size distribution index (GSDv) of the present invention may also be defined by using as a lower limit an upper limit or a lower limit in the above-mentioned ranges, or alternatively, a value of a volume average particle size distribution index (GSDv) in the examples described later, while using as an upper limit an upper limit or a lower limit in the above-mentioned ranges, or alternatively, a value of a volume average particle size distribution index (GSDv) in the examples described later.

If the volume average particle size distribution index (GSDv) exceeds 1.3, the toner cannot provide a high-quality and a high reliability of images at the same time. More specifically, the toner for developing an electrostatic image or the developer for an electrostatic image comprising the toner has an undesirably short life and the resolution becomes worse. In addition, developability becomes worse with time due to, for example, selective development.

The ratio of a volume average particle size distribution index (GSDv) to a number average particle size distribution index (GSDp), i.e., (GSDv)/(GSDp), of the toner for developing an electrostatic image according to the present invention needs to be 0.95 or more, and is preferably 0.96 or more, more preferably in the range of from 0.96 to 1.10.

In addition to the above-mentioned ranges, a preferable range of the ratio, (GSDv)/(GSDp), of the present invention may also be defined by using as a lower limit an upper limit or a lower limit in the above-mentioned ranges, or alternatively, a value of the ratio, (GSDv)/(GSDp), in the examples described later, while using as an upper limit an upper limit or a lower limit in the above-mentioned ranges, or alternatively, a value of the ratio, (GSDv)/(GSDp), in the examples described later.

If the ratio, (GSDv)/(GSDp), is less than 0.95, the particle size distribution of the toner for developing an electrostatic image is so broad that the fine particles contained in the toner strongly adhere to a photorecepter during development and generate black spots on the photorecepter. Further, in the case of a two-component developer using the toner, the fine particles tend to adhere to carriers to an extent that the carriers are contaminated, and consequently the life of the developer becomes shorter. On the other hand, in the case of a one-component developer using the toner, the fine particles tend to strongly adhere to members such as developing rolls, electrified rolls, trimming rolls and blades to an extent that these members are contaminated, and consequently the quality of an image becomes poor.

The reason for setting the preferable upper limit of the ratio, (GSDv)/(GSDp), to 1.10 is based on the practical fact that GSDp is rarely much over GSDv excluding errors in measurement.

Generally speaking, a more preferable range of the ratio, (GSDv)/(GSDp), is about 1.0. This means that, in order to perform excellent developability and high-quality images, it is important for a number average particle size distribution index (GSDp) not to differ much from a volume average particle size distribution index (GSDv) in addition to the requirement that the volume average particle size distribution index (GSDv) be in the aforementioned range.

In the case of toner prepared by a conventional blending/pulverizing process, the ratio, (GSDv)/(GSDp), is generally distributed within the range of from 0.92 to 0.96. However, the toner having the ratio, (GSDv)/(GSDp), of more than 0.95 can be obtained only when the sieving is performed very carefully, and therefore is too expensive to be used for general purpose. Therefore, it is particularly preferable to obtain the toner for developing an electrostatic image according to the present invention which has the aforementioned particle size distribution by the method for producing the toner which is described later. The method for producing the toner for developing an electrostatic image is advantageous in that the toner having the ratio, (GSDv)/(GSDp), of more than 0.95 can be obtained efficiently.

If toner for developing an electrostatic image contains an external additive whose particle sizes are smaller than those of toner particles, the ratio, (GSDv)/(GSDp), markedly decreases. Therefore, the prescribed range for the ratio, (GSDv)/(GSDp), applies to the case where toner for developing an electrostatic image does not contain any external additive.

The material and the like for the toner according to the present invention are not particularly limited and the toner according to the present invention can be obtained by an appropriately selected method. It particularly preferable to obtain the toner according to the present invention by the method of producing the toner according to the present invention.

Next, the method for producing the toner for developing an electrostatic image according to the present invention is described, and the details of the preferable materials and the like for the toner are clarified through the explanations about the method.

Method of Producing Toner for Developing an Electrostatic Image

The method for producing toner for developing an electrostatic image according to the present invention comprises the steps of preparing a dispersion liquid of comprises the steps of preparing a dispersion liquid of flocculated particles by forming the flocculated particles in a dispersion liquid containing at least resin particles dispersed therein (hereinafter referred to as "a first step" on occasion), forming adhered particles by admixing a dispersion liquid comprising fine particles dispersed therein with the dispersion liquid of the flocculated particles so that the fine particles adhere to the flocculated particles (hereinafter referred to as "a second step" on occasion) and forming toner particles by heating the adhered particles so that the fine particles fuse into the flocculated particles (hereinafter referred to as "a third step" on occasion). The method may include other additional steps, if necessary.

In the first step, the resin particles and the like dispersed uniformly in the dispersion liquid flocculate to form the flocculated particles.

In the second step, the dispersion liquid of the fine particles admixed with the dispersion liquid of the flocculated particles so as to form the adhered particles wherein the fine particles adhere uniformly to the surface of the flocculated particles as mother particles. The flocculated particles and the adhered particles are prepared by, for example, a heterogeneous flocculation method. More specifically, when forming the particles, the polarities and amounts of ionic surfactants in the adding dispersion liquid and in the being added dispersion liquid are set in an unbalanced relationship in advance and the two dispersion liquids are admixed such that the unbalance of the surfactants is compensated.

In the third step, the resins in the adhered particles are fused to be united with the resins with the fine particles and consequently the toner particles for developing an electrostatic image are formed.

A First Step

The first step is a step where a dispersion liquid of flocculated particles is prepared by forming the flocculated particles in the dispersion liquid (hereinafter the first step is referred to as "a flocculation step" on occasion).

The dispersion liquid contains at least resin particles dispersed therein.

The resin for the resin particles is, for example, a thermoplastic resin, specific examples of which include homopolymers or copolymers of styrenes (styrene-based resins) made from, for example, styrene, p-chlorostyrene and α-methylstyrene; homopolymers or copolymers of esters having at least one vinyl group (vinyl-based resins) made from, for example, methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate; homopolymers or copolymers of vinyl nitriles (vinyl-based resins) made from, for example, acrylonitrile and methacrylonitrile; homopolymers or copolymers of vinyl ethers (vinyl-based resins) made from, for example, vinyl methyl ether and vinyl isobutyl ether; homopolymers or copolymers of vinyl ketones (vinyl-based resins) made from, for example, vinyl methyl ketone, vinyl ethyl ketone and vinyl isopropenyl ketone; homopolymers or copolymers of olefins (olefin-based resins) made from, for example, ethylene, propylene, butadiene and isoprene; non-vinyl condensation resins such as epoxy resins, polyester resins, polyurethane resins, polyamide resins, cellulose resins and polyether resins; and graft polymers made from any of these non-vinyl condensation resins and a vinyl monomer. These resins may be used independently or in a combination of two or more.

Among the foregoing resins, vinyl-based resins are particularly preferable. The vinyl-based resins are advantageous in that a dispersion liquid of resin particles can be easily prepared by an emulsion polymerization or a seed polymerization utilizing an ionic surfactant or the like.

The vinyl monomers include monomers as starting materials for vinyl polymer acids or vinyl polymer bases such as acrylic acid, methacrylic acid, maleic acid, cinnamic acid, fumaric acid, vinylsulfonic acid, ethyleneimine, vinylpyridine, and vinylamine. In the present invention, it is preferable that the resin particles comprise any of these vinyl monomers as a monomer component. In the present invention, among the foregoing vinyl monomers, monomers for vinyl polymer acids are preferable from the aspect of ease in forming reaction of the vinyl resin and the like. Particularly preferable vinyl monomers are dissociative vinyl monomers having carboxyl groups as a dissociative group, and examples of these monomers include acrylic acid, methacrylic acid, maleic acid, cinnamic acid and fumaric acid. These monomers are preferable from the viewpoint of ease in controlling degrees of polymerization and glass transition points.

For the determination of the concentration of the dissociative group of the above-mentioned dissociative vinyl monomers, an employable method is, for example, a method which is described in "Chemistry of Polymer Latices" (published from Kohbunshi Kankoh Kai—Society for Publishing Polymers—) and in which the particles such as toner particles are dissolved the surface and the concentration is then determined. According to this method, it is also possible to measure the molecular weight and the glass transition point of the resin in the region ranging from the surface to the interior of the particle.

The average particle diameter of the resin particles is usually 1 μm or less, and is preferably in the range of from 0.01 to 1 μm.

If the average particle diameter is greater than 1 μm, the particle size distribution of the finally resulting toner for developing an electrostatic image is broadened or free particles are generated, and therefore the quality and the reliability tend to drop. On the other hand, if the average diameter is within the range, there are not the above-mentioned drawbacks and the fluctuation in qualities and reliabilities of toner particles are lowered because the resins are not localized among toner particles and well dispersed in the toner. The average diameter can be measured by using, for example, a microtrack.

In the present invention, the above-mentioned dispersion liquid needs to contain a colorant dispersed therein, if the dispersion liquid of fine particles to be used in the second step contains no colorant.

The colorant may be dispersed in the dispersion liquid of the resin particles, or alternatively, a dispersion liquid comprising the colorant dispersed therein may be blended into the dispersion liquid of the resin particles.

Examples of the colorants include pigments such as carbon black, chromium yellow, Hansa yellow, benzidine yellow, threne yellow, quinoline yellow, permanent orange GTR, pyrazolone orange, Balkan orange, watchung red, permanent red, brilliant carmine 3B, brilliant carmine 6B, DuPont oil red, pyrazolone red, Lithol red, rhodamine B lake, lake red C, rose bengal, aniline blue, ultramarine blue, chalcoyl blue, methylene blue chloride, phthalocyanine blue, phthalocyanine green, and Malachite green oxalate; and dyes such as acridine dyes, xanthene dyes, azo dyes, benzoquinone dyes, azine dyes, anthraquinone dyes, dioxazine dyes, thiazine dyes, azomethine dyes, indigo dyes, thioindigo dyes, phthalocyanine dyes, aniline black dyes, polymethine dyes, triphenylmethane dyes, diphenylmethane dyes, thiazine dyes, thiazole dyes, and xanthene dyes. These colorants may be used independently or in a combination of two or more.

The average particle diameter of the colorants is usually 1 μm or less, preferably 0.5 μm or less, and most preferably in the range of from 0.01 to 0.05 μm.

If the average particle diameter is greater than 1 μm, the particle size distribution of the finally resulting toner for developing an electrostatic image is broadened or free particles are generated, and therefore the quality and the reliability tend to drop.

On the other hand, if the average diameter is within the range, there are not the above-mentioned drawbacks and the fluctuation in qualities and reliabilities of toner particles are lowered because the colorant particles are not localized among toner particles and well dispersed in the toner. Further, if the average particle diameter is 0.5 μm or less, the resulting toner is excellent in qualities such as color formation, color reproduction and transmissivity in OHP. The average diameter can be measured by using, for example, a microtrack.

If a colorant and the resin particles are used together in the dispersion liquid mentioned above, the combination is not particularly limited and a combination is selected at will according to purposes.

In the present invention, according to purposes, the dispersion liquid may contain dispersed therein other components (particles) such as a release agent, an internal additive, a charge controller, particles of an inorganic substance, particles of an organic substance, a lubricant, and an abrasive.

Particles of the other components (particles) may be dispersed in the dispersion liquid containing the dispersed resin particles, or alternatively, a dispersion liquid comprising dispersed particles of the other components (particles) may be blended into the dispersion liquid of the resin particles.

Examples of the release agent include polyolefins having a low molecular weight such as polyethylene, polypropylene and polybutene; silicones which soften by heating; fatty acid amides such as oleic amide, erucic amide, ricinoleic amide and stearic amide; vegetable waxes such as carnauba wax, rice wax, candelilla wax, wood wax and jojoba oil; animal waxes such as beeswax; mineral/petroleum waxes such as montan wax, ozokerite, ceresin, paraffin wax, microcrystalline wax and Fischer-Tropsch wax, and modified products of these substances.

These waxes can be easily prepared as particles having a particle diameter of 1 μm or less by a process comprising dispersing the wax in water together with an ionic surfactant and a polymer electrolyte such as a polymer acid or a polymer base, heating at a temperature above the melting point of the wax, and applying a strong shearing force to the resulting dispersion by means of a homogenizer or a pressure-ejection type dispersing machine.

The internal additives include magnetic substances, such as metals, alloys, and compounds containing these metals such as ferrite, magnetite, reduced iron, cobalt, nickel, and manganese.

The charge controllers include quaternary ammonium compounds, nigrosine-based compounds, dyes such as a complex of aluminum, iron, chromium or the like, and triphenylmethane pigments. In the present invention, a charge controller having a low solubility in water is preferable from the viewpoint of the control of the ionic strength that influences the stability at the time of flocculation and fusion and also from the viewpoint of reduction of the contaminated waste water.

The inorganic particles include silica, alumina, titania, calcium carbonate, magnesium carbonate, calcium tertiary phosphate and cerium oxide, which are usually used as external additives to the surface of toner.

The organic particles include vinyl resins, polyester resins and silicone resins, which are usually used as external additives to the surface of toner. These inorganic or organic particles can be used as a fluidity aid, a cleaning aid or the like.

The lubricants include fatty acid amides, such as ethylenebisstearic amide and oleic amide, and metal salts of fatty acids such as zinc stearate and calcium stearate.

The abrasives include silica, alumina and cerium oxide mentioned above.

The average particle diameter of the above-mentioned other components is usually 1 μm or less, and preferably in the range of from 0.01 to 1 μm. If the average particle diameter is greater than 1 μm, the particle size distribution of the finally resulting toner for developing an electrostatic image is broadened or free particles are generated, and therefore the qualities and the reliabilities of toner tend to drop. On the other hand, if the average diameter is within the range, there are not the above-mentioned drawbacks and the fluctuation in qualities and reliabilities of toner are lowered because these components are not localized among toner particles and well dispersed in the toner. The average diameter can be measured by using, for example, a microtrack.

An example of the dispersing medium of the aforementioned dispersion liquids is an aqueous medium. Examples of the aqueous medium include water, such as purified water or ion-exchanged water, and an alcohol. These media may be used independently or in a combination of two or more.

In the present invention, it is preferable that the above-mentioned aqueous medium contain a surfactant.

The surfactants include anionic surfactants, such as sulfate ester salts, sulfonate salts, phosphate ester and soaps; cationic surfactants, such as amine salts and quaternary ammonium salts; and nonionic surfactants such as polyethylene glycol, alkylphenol/ethylene oxide adducts and polyvalent alcohols. Among these surfactants, ionic surfactants are preferable, and anionic surfactants and cationic surfactants are more preferable.

The nonionic surfactant is used preferably in a combination with ananionic surfactant or a cationic surfactant. These surfactants may be used independently or in a combination of two or more.

The anionic surfactants include sodium dodecylbenzenesulfonate, sodium dodecyl sulfate, sodium alkylnaphthalenesulfonate and sodium dialkylsulfosuccinate. The cationic surfactants include alkylbenzenedimethylammonium chloride, alkyltrimethylammonium chloride, and distearylammonium chloride.

The content of the resin particles in the aforementioned dispersion liquid is 40% by weight or less, preferably 2 to 20% by weight, at the time when the flocculated particles are formed.

When the colorant or the magnetic substance is also dispersed in the dispersion liquid, the content of the colorant or the magnetic substance in the dispersion liquid is 50% by weight or less, preferably 2 to 20% by weight, at the time when the flocculated particles are formed.

Further, when the aforementioned other component (particles) is also dispersed in the dispersion liquid, the content of the other component in the dispersion liquid is an amount which achieves the objectives of the present invention and which is generally a very small amount, namely, 0.01 to about 5% by weight, and preferably 0.5 to 2% by weight, at the time when the flocculated particles are formed. If the content is outside the range, the other component may bring about little effect or may lead to the broadening of the particle size distribution which impairs qualities.

A method for preparing the dispersion liquid containing at least resin particles dispersed therein is not particularly limited and may be selected at will according to purposes. For example, the dispersion liquid can be prepared by the following methods.

In the case where the resin component in the resin particles is a homopolymer or a copolymer of vinyl monomers (vinyl-based resins) such as esters having vinyl group, the vinyl nitrites, the vinyl ethers, the vinyl ketones or the like which are each mentioned earlier, a dispersion liquid, which contains the resin particles made up of a homopolymer or a copolymer of vinyl monomers (vinyl-based resins) dispersed with an ionic surfactant, is prepared by carrying out an emulsion polymerization or a seed polymerization of the vinyl monomers in liquid containing the ionic surfactant.

In the case where the resin component in the resin particles is a resin other than homopolymers and copolymers of the vinyl monomers, a dispersion liquid, which comprises the resin particles dispersed with an ionic surfactant, is prepared by a process comprising dissolving the resin in an oily solvent, if the resin has a relatively low solubility in water and is soluble in the solvent, adding the resulting solution to water together with the ionic surfactant or a polymer electrolyte, dispersing fine particles in the mixed solution by means of a dispersing machine such as a homogenizer, and then evaporating the oily solvent by means of heating or reduced pressure.

The dispersion liquid comprising the aforementioned colorant dispersed therein can be prepared by, for example, dispersing the colorant in an aqueous medium containing the aforementioned surfactant or the like, while the dispersion liquid comprising the aforementioned other components (particles) dispersed therein can be prepared by, for example, dispersing the other components (particles) in an aqueous medium containing the aforementioned surfactant or the like. Further, a dispersion liquid having dispersed therein composite particles, which comprise the resin and the colorant and/or the other components (particles), can be prepared by a process comprising dissolving and dispersing the resin, the colorant and the like in a solvent, adding the resulting dispersion liquid to water together with an appropriate dispersing agent as described above so as to obtain the dispersion liquid of composite particle, and then eliminating the solvent by means of heating or reduced pressure. Alternatively, the dispersion liquid comprising the composite particles dispersed therein can be prepared by immobilizing the colorant and/or the other component (particles) onto the surface of the particles of a latex, which is prepared by an emulsion polymerization or a seed polymerization, by mechanical shearing or electrical adsorption. These methods are effective in inhibiting the separation of the colorant and the like from the surface and in obviating the chargeability dependence of toner for developing an electrostatic image on the colorant.

The dispersing means is not particularly limited, and the dispersing machines hitherto known may be used. Examples of these machines include a homogenizer with a rotating shearing mechanism, a ball mill with media, a sand mill and a Dyno mill.

The flocculated particles are prepared by, for example, the following methods.

A first dispersion liquid, wherein at least the resin particles are dispersed in an aqueous medium containing the ionic surfactant, is mixed with (1) an ionic surfactant having an opposite polarity to that of the foregoing ionic surfactant, or (2) an aqueous medium blended with the ionic surfactant (1), or (3) a second dispersion liquid containing the aqueous medium (2).

When the resulting mixture is stirred, the resin particles and the like are flocculated in the dispersion liquid by the action of the ionic surfactant so that the dispersion liquid of the flocculated particles is prepared.

The above-described mixing is carried out preferably at a temperature below the glass transition point of the resin contained in the mixture. The mixing at such a temperature ensures a flocculating operation in a stable state.

The second dispersion liquid mentioned above comprises dispersed therein the resin particles, the colorants and/or the other component (particles).

In the present invention, the selection of the stirring means is important. An example of the stirring means suitable for use in the present invention is an apparatus or a machine comprising a stirring blade whose width is not smaller than one half of the depth of the dispersion liquid (i.e., the liquid to be stirred) placed in a vessel for receiving the dispersion liquid.

If the dispersion liquid is stirred by using a stirring means comprising such a stirring blade, the resin particles and others in the dispersion liquid can be flocculated uniformly. To the contrary, if a stirring blade whose width is smaller than one half of the depth of the dispersion liquid is used, the resin particles and others in the dispersion liquid cannot be flocculated uniformly and therefore the particle size distribution may be undesirably broadened.

If the particle size distribution is broadened, the fine particles contained in the toner for developing an electrostatic image strongly adhere to a photorecepter at the time of development and consequently generate black spots on the photorecepter. Further, in the case of a two-component developer using the toner, the fine particles tend to adhere to carriers to an extent that the carriers are contaminated, and the life of the developer becomes shorter. On the other hand, in the case of a one-component developer using the toner, the fine particles strongly adhere to members such as developing rolls, electrified rolls, trimming rolls and blades and qualities of images become poor.

In the present invention, from the standpoint of ensuring uniform stirring, a stirring blade whose width is not smaller than one third of the diameter of the dispersion liquid (i.e., the liquid to be stirred) placed in a vessel for receiving the dispersion liquid is preferable.

As for the shape of the stirring blade, a flat plate blade is particularly preferable. Examples of the flat plate blade include commercially available ones such as Max Blend blade manufactured by Sumitomo Heavy Industries Ltd. and Full Zone blade manufactured by Shinko-Pantec Co., Ltd.

In the case of (1) or (2), the flocculated particles are formed by the flocculation of the resin particles together in the first dispersion liquid.

In this case, the content of the resin particles in the first dispersion liquid is usually 5 to 60% by weight, and preferably 10 to 40% by weight. When the flocculated particles are formed, the content of the flocculated particles in the dispersion liquid comprising the flocculated particles is usually 40% by weight or less.

In the case of (3), if the particles dispersed in the second dispersion liquid are the resin particles, the flocculated particles are composed of the resin particles of the second dispersion liquid and the resin particles dispersed in the first dispersion liquid. Further, if the particles dispersed in the second dispersion liquid are the colorant and/or the other component (particles), the flocculated particles are, for example, heterogeneously flocculated particles composed of the colorant and/or the other component (particles) and the resins dispersed in the first dispersion liquid. Furthermore, if the particles dispersed in the second dispersion liquid are the resin particles, the colorant and/or the other component (particles), the flocculated particles are, for example, composed of the resin particles, the colorant and/or the other component (particles) and the resins dispersed in the first dispersion liquid.

In this case, the content of the resin particles in the first dispersion liquid is usually 5 to 60% by weight, and preferably 10 to 40% by weight. The content of the resin particles, the colorant and/or the other component (particles) in the second dispersion liquid is usually 5 to 60% by weight, and preferably 10 to 40% by weight. If the content is outside the range, the particle size distribution is broadened and the qualities may become worse. When the flocculated particles are formed, the content of the flocculated particles in the dispersion liquid comprising the flocculated particles is usually 40% by weight or less.

When the flocculated particles or the adhered particles are formed, it is preferable to select the surfactant in the adding dispersion liquid and the another surfactant in the being added dispersion liquid so that these polarities are opposite to each other, and to change the polarity balance. Accordingly, even if the resin in the resin particles and the colorant have the same polarity, uniformly flocculated particles can be formed from the resin particles and the colorant by adding surfactant having opposite polarity to the polarity of the resin particles.

The average particle diameter of the flocculated particles to be formed is not particularly limited. The average particle diameter of the flocculated particles is usually controlled to approximately the same average particle diameter as that of the desired toner for developing an electrostatic image. The controlling operation for this purpose can be easily performed by setting/altering the conditions of, for example, temperatures and the blending operations.

According to the first step described above, the flocculated particles are formed which have approximately the same average particle diameter as that of the desired toner for developing an electrostatic image. And, a dispersion liquid of the flocculated particles is prepared. In the present invention the above-mentioned flocculated particles are referred to as "mother particles" on occasion.

A Second Step

A second step consists in the formation of adhered particles by admixing a liquid dispersion comprising fine particles with the dispersion liquid of the flocculated particles so that the fine particles adhere to the flocculated particles (hereinafter the second step is referred to as "an adhering step" on occasion).

In the present invention, it is particularly preferable to carry out the above-mentioned mixing by the aforementioned means. The reason for this is as set forth earlier. In the second step, the term "dispersion liquid (i.e., the liquid to be stirred)" in the explanation about the stirring means is replaced by "mixture liquid (i.e., the liquid to be stirred)".

If the mixture liquid is stirred by using a stirring means comprising such a stirring blade, the fine particles in the dispersion liquid comprising the fine particles can be adhered uniformly onto the surface of the flocculated particles. To the contrary, if a stirring blade whose width is smaller than one half of the depth of the liquid is used, the particle size distribution tends to be undesirably broadened because the fine particles expected to adhere to the flocculated particles may remain free or because the fine particles once adhered to the flocculated particles may be separated.

Examples of the fine particles include the resin particles, the colorant particles of the colorant and the particles of the other component (particles). Examples of the dispersion liquid comprising the fine particles include a dispersion liquid comprising the resin particles dispersed therein, a dispersion liquid comprising the colorant dispersed therein, and a dispersion liquid comprising the other component (particles) dispersed therein such as a dispersion liquid comprising the release agent dispersed therein. The dispersion liquids of fine particles may be used independently or in a combination of two or more.

The fine particles such as the resin particles adhere uniformly to the surface of the flocculated particles to thereby form adhered particles and the resulting adhered particles are fused by heating in the third step. If the flocculated particles contain a colorant and a release agent, the surfaces of particles are coated with the fine particles (formation of a shell), and, as a result, the exposure or the like of these components such as a release agent on toner particles can be effectively prevented.

When preparing multicolor toner for developing an electrostatic image, if the resin fine particles are used in the second step, the surface of the flocculated particles prepared by the flocculation of the resin particles and the colorant is coated with a layer of the resin fine particles. Accordingly, the influence of the colorant on the electrified behavior can be minimized so that the difference in the electrified properties depending on the kinds of the colorants can be minimized. Further, if a resin having a high glass transition point is selected as the resin for the resin fine particles, the toner thus obtained for developing an electrostatic image are excellent both in thermal storability and in fixability, and has an excellent chargeability.

In the second step, if a dispersion liquid, wherein a release agent such as a wax is dispersed as the fine particles, is added first, and thereafter a dispersion liquid, wherein resin particles having a high hardness or inorganic particles are dispersed as the fine particles, is added, a shell composed of the resin particles having a high hardness or the inorganic particles can be formed on the outermost surface of toner particle. In this way, it is possible to allow the wax to effectively function as a release agent in the fixing process while the wax is prevented from being exposed.

As described above, it is possible to cover the surface of toner particles with a resin or an electrified controller, and to allow a colorant or a release agent to be present in the vicinity of the surface of toner particle.

The average particle diameter of the fine particles is usually 1 $\mu$m or less, and is preferably in the range of 0.01 to 1 $\mu$m. If the average particle diameter is greater than 1 $\mu$m, the particle size distribution of the finally resulting toner for developing an electrostatic image is broadened or free particles are generated, and therefore the qualities and the reliabilities tend to drop. On the other hand, if the average diameter is within the range, the fine particles do not exhibit the above-mentioned drawbacks and are advantageous in forming a layer structure by the fine particles. The average diameter can be measured by using, for example, a microtrack.

The volume of the fine particles depends on the volume fraction of the toner obtained for developing an electrostatic image, and is preferably 50% or less of the volume of the toner. If the volume of the fine particles exceeds 50% of the volume of the toner, it will be difficult to obtain the desired quality of the toner due to increase in the fluctuation in the compositional distribution or the particle size distribution of the toner, because the fine resin particles do not adhere/flocculate onto the flocculated particles but instead form new flocculated particles.

For the preparation of the dispersion liquid comprising the fine particles, a single kind of the particles may be dispersed, or two or more kinds of the fine particles in a combination may be dispersed. In the latter case, the combination of the kinds of the fine particles is not particularly limited and the combination can be selected appropriately depending on the purpose.

The dispersing medium of the dispersion liquid comprising the fine particles is, for example, the aforementioned aqueous medium. In the present invention, the aqueous medium preferably contains at least one surfactant.

The fine particle content of the dispersion liquid comprising the fine particles is usually 5 to 60% by weight, and preferably 10 to 40% by weight. If content is outside the range, it may be difficult to fully control the structure and composition in the region ranging from the interior to the surface of the particle of toner for developing an electrostatic image. When the flocculated particles are formed, the content of the flocculated particles in the dispersion liquid comprising the flocculated particles is usually 40% by weight or less.

The dispersion liquid comprising the fine particles is prepared, for example, by dispersing at least one kind of the aforementioned fine particles in an aqueous medium which contains at least one ionic surfactant or the like. Alternatively, the dispersion liquid comprising the fine particles can be prepared by adsorbing or immobilizing at least one kind of the fine particles onto the surface of the particles of a latex, which is prepared by an emulsion polymerization or a seed polymerization, by mechanical shearing or electrical force.

In the second step, a liquid dispersion comprising the fine particles is admixed with the dispersion liquid comprising flocculated particles which is prepared at the first step so that adhered particles are formed by adhering the fine particles to the surface of the flocculated particles. Since the fine particles are regarded as newly adding particles to the flocculated particles, the fine particles are herein referred to as "added particles" on occasion.

The admixing method is not particularly limited. For example, the admixing operation may be carried out continuously or stepwise continuous such as operation is divided into plural steps. If carried out as described above, the admixing of the fine particles (adding particles) makes it possible to inhibit the formation of fine particles and to narrow the particle size distribution of the obtained toner for developing an electrostatic image. At the same time, it is possible to vary gradually the structure and the composition in the region ranging from the interior to the surface of the particle of the toner and thus it is possible to easily control the structure of the toner.

Further, it is possible to obtain the fluidity and the storability together with the reduction in minimum fixing temperature of toner by selecting the resin for the resin particles and the resin for the fine particles in such a way that the glass transition point of the resin existing in the exterior of the toner particle is higher than the glass transition point of the resin present in the interior of the toner particle.

Also, it is possible to prevent the offset to a heat roll by increasing the elasticity in a fused state by increasing the molecular weight of the resin on the higher molecular weight side. This is a very effective means in the case where oil coating is not implemented.

The fluidity and the transferability of toner are improved owing to the enhancement of the surface evenness of the toner particle, if the resins are selected in such a way that the molecular weight of the resin existing in the exterior of the toner particle (i.e., the resin in the fine particles) is smaller than the molecular weight of the resin existing in the interior of the toner particle (i.e., the resin in the flocculated particles). In this case, if the flocculated particles are not made from a single resin and therefore the flocculated particles comprise two or more resins, the molecular weight of the resin present in the interior of the toner particle (i.e., the resin in the flocculated particles) means an average of the molecular weights of all resins contained in the flocculated particles.

If the molecular weight of the resin existing in the exterior of toner particle differs extremely from the molecular weight of the resin existing in the interior of the toner particle, the adhesion between the core and the coating layer of the obtained toner particle may decrease. In this case, the toner particles may be destroyed if a mechanical stress is applied to the toner particles by stirring or by blending thereof with carrier particles in a developing apparatus.

Accordingly, when the fine particles are adhered to the flocculated particles, it is possible to employ a process comprising firstly adhering resin fine particles, which have a molecular weight and/or glass transition point midway between those of the resin present in the exterior of toner particle and those of the resin present in the interior of the toner particle, to the flocculated particles and thereafter adhering selected resin fine particles to the flocculated particles.

If the admixing of the fine particles is performed stepwise in plural times, it is possible to create a gradient of structural and compositional change in the region ranging from the interior to the exterior of toner particle for developing an electrostatic image, because this admixing treatment makes it possible to stack the layers of the fine particles stepwise on the surface of the flocculated particles. By this process, it is also possible to increase the surface hardness of the toner particles. Further, it is possible to maintain a desired particle size distribution, to inhibit the fluctuation in the distribution, to dispense with the use of a stabilizing agent such as a surfactant, base or acid designed for the improvement of the fusion stability in the third step, or to minimize the amount added of such an agent. Consequently, this process is advantageous in cost reduction and in improvement of the quality.

The operational conditions for adhering the fine particles to the flocculated particles are described below.

The temperature is lower than the glass transition point of the resin in the resin particles used for first step, and the temperature is preferably about room temperature. If heating is performed at a temperature lower than the glass transition point, the adhesion between the flocculated particles and the fine particles is enhanced and therefore the adhered particles which are formed become more stable.

The treating time depends on the temperature and therefore cannot be stipulated unqualifiedly. The treating time is usually 5 minutes to about 2 hours.

In the adhering operation, the dispersion liquid containing the flocculated particles and the fine particles may be in a stationary state or may be gently agitated by means of a mixer or the like. The latter treatment is advantageous, because uniform adhered particles are more easily produced.

In the present invention, the second step may be performed once or plural times. In the former case, a single layer of the fine particles (adding particles) is formed on the surface of the flocculated particles. However, in the latter case, if two or more kinds of the dispersion liquids comprising the fine particles are used, layers of the fine particles (adding particles) contained in these dispersion liquids comprising the fine particles are laminated on the surface of the flocculated particles. Therefore, the latter case is more advantageous, because it enables to produce toner having a complicated and precise laminated structure for developing an electrostatic image and to impart desired functions to the toner.

If the second step is repeated plural times, the kind of the fine particles (adding particles) to be adhered to the flocculated particles (mother particles) at the first admixing and the kind of the fine particles (adding particles) to be adhered to the flocculated particles at the second or subsequent admixing may be selected at will depending on, for example, the intended use of toner for developing an electrostatic image.

If the second step is repeated plural times, it is preferable to heat up the dispersion liquid containing the fine particles and the flocculated particles at a temperature lower than the glass transition point of the resin in the resin particles of the first step, and it is more preferable to raise stepwise the heating temperature. This process is advantageous in that it enables to stabilize the adhered particles and to prevent the formation of free particles.

As stated above, by the second step the adhered particles wherein the fine particles adhered to the flocculated particles prepared in the first step. If the second step is repeated plural times, the fine particles are adhered plural times to the flocculated particles which are prepared in the first step to thereby form the adhered particles. Accordingly, by the selection of the fine particles to be adhered to the flocculated particles, it is possible to design and produce at will toner having desired characteristics for developing an electrostatic image by adhering appropriately selected fine particles to the flocculated particles.

The distribution of the colorant within the adhered particle becomes the distribution of the colorant within the finally resulting toner particle. Accordingly, the more finely and uniformly the colorant disperses within the adhered particle, the better the color formation of the resulting toner will be.

A Third Step

The third step consists in fusing by heating the adhered particles to prepare toner particles (hereinafter the third step is referred to as "a fusion step" on occasion).

The heating temperature is a temperature in the range of from the glass transition point to the decomposition temperature of the resin contained in the adhered particles. Accordingly, the heating temperature varies depending on the kinds of the resins in the resin particles and in the fine particles and cannot be stipulated unqualifiedly. The heating temperature is generally in the range of from the glass transition point of the resin contained in the adhered particles to 180° C.

The heating can be performed by heaters and apparatus which themselves are known.

The time required for the fusion is shorter if the heating temperature is higher and the time is longer if the heating temperature is lower. That is, the fusion time varies depending on the heating temperature and therefore it cannot be stipulated unqualifiedly. The fusion time is usually 30 minutes to about 10 hours.

In the present invention, after the completion of the third step, the toner obtained for developing an electrostatic image can be washed and thereafter dried under appropriate conditions. The surface of the toner obtained may be admixed with inorganic particles, such as silica, alumina, titania and calcium carbonate, or with particles of resins, such as vinyl resins, polyester resins and silicone resins, in a dry state by means of a shearing force. These inorganic particles and particles of resins function as external additives to improve the fluidity or the cleanability of the toner.

By the third step described above, the adhered particles, which are prepared in the second step, are fused while maintaining the structure of the adhered particles in which the fine particles (adding particles) adhere to the surface of the flocculated particles (mother particles), and toner for developing an electrostatic image is prepared in this way.

The toner which is designed for developing an electrostatic image and which is obtained by the above-described method for producing the toner has a structure in which the flocculated particles act as mother particles and a coating layer of the fine particles (adding particles) is formed on the surface of the mother particles. The coating layer composed of the fine particles (adding particles) may be made up of one layer, or may be made up of two or more layers. Generally, the number of the layers is equal to the number of repetitions of the second step in the method for producing the toner according to the present invention.

The toner for developing an electrostatic image has a structure in which the composition, the physical property and the like change continuously or discontinuously in the region ranging from the interior to the exterior of the toner particle wherein the change is controlled within a desired range and is well balanced. Therefore, the toner is excellent in characteristics such as chargeability, developability, transferability, fixability, cleanability and particularly in chargeability. Further, the toner has a high reliability, because it maintains and exhibits the above-mentioned characteristics and particularly the chargeability without being influenced by the environmental conditions.

Since the toner for developing an electrostatic image is prepared by the above-described method of the present invention for preparing the toner, the toner thus prepared has a small average particle diameter and yet the particle size distribution is sharp unlike the toner prepared by a blending/pulverizing process or the like.

The particle size distribution of the toner for developing an electrostatic image is the one set forth earlier.

The average particle diameter of the toner is preferably 2 to 9 μm and more preferably 3 to 8 μm. If the average particle diameter is less than 2 μm, the chargeability tends to be insufficient and the developability tends to drop, whereas if the average particle diameter exceeds 9 μm, the resolution of image may drop.

The charge amount of the toner is preferably 10 to 40 μC/g, and more preferably 15 to 35 μC/g. If the charge amount is less than 10 μC/g, background fog tends to occur, whereas if the charge amount exceeds 40 μC/g, the reduction in the image density tends to occur.

The ratio of the charge amount of the toner in summer to the charge amount of the toner in winter is preferably 0.5 to 1.5, and more preferably 0.7 to 1.3. If the ratio is outside the range, the stability level of the chargeability may not come up to practical required level because the toner properties become strongly dependent on the environmental conditions.

Electrostatic Images Developer

There is no particular restriction placed on the developer for an electrostatic image according to the present invention except for the requirement that the developer comprise the toner for developing an electrostatic image according to the present invention. Therefore, the developer may have an appropriate composition according to purposes.

If the toner for developing an electrostatic image according to the present invention is used independently, the electrostatic images developer according to the present invention is prepared as a one-component developer. If the toner for developing an electrostatic image according to the present invention is combined with a carrier, the developer according to the present invention is prepared as a two-component developer.

The carrier to be used herein is not particularly limited and the carrier itself may be a known one. For example, the resin-coated carriers described in, for example, Japanese Patent Application Laid-Open (JP-A) Nos. 62-39,879 and 56-11,461, can be used.

In the developer, the mixing ratio of the toner and the carrier is not particularly limited and can be appropriately selected according to purposes.

Method for Forming an Image

The method for forming an image according to the present invention includes steps of forming an electrostatic latent image, forming a toner image, transferring the toner image, and a cleaning step.

These steps themselves are generally known and are described in, for example, Japanese Patent Application Laid-Open (JP-A) Nos. 56-40,868 and 49-91,231. The method for forming an image according to the present invention can be carried out by use of an image forming apparatus such as a copying machine or a facsimile device which themselves are known.

The step of forming a latent electrostatic image consists in the formation of an electrostatic latent image, on an electrostatic latent image carrier. The step for forming a toner image consists in the formation of a toner image by developing the electrostatic latent image by use of a developer layer on a developer carrier. The developer layer is not particularly limited except that it contains a developer comprising the toner for developing an electrostatic image according to the present invention. The step for transferring the toner image consists in transferring the toner image onto an image receiving medium. The cleaning step consists in removing the residue of a toner agent from the electrostatic latent image carrier.

The image forming method according to the present invention preferably include a recycling step in addition.

The recycling step consists in restoring the developer recovered in the cleaning step to the developer layer.

The embodiments of the image forming method which include the recycling step can be applied to an image forming apparatus such as a copying machine or a facsimile device equipped with a toner recycling system. The method for forming an image may be applied to a copying machine or a facsimile device, in which the cleaning step is not employed and the toner is recovered simultaneously with the developing operation.

The present invention will be further clarified by the following examples, which should not be viewed as a limitation on any embodiment of the invention.

EXAMPLE 1

A First Step

Preparation of a Dispersion Liquid Containing Resin Particles 1

| | |
|---|---|
| Styrene | 340 g |
| n-butyl acrylate | 66 g |
| Acrylic acid | 8 g |
| Dodecanethiol | 10 g |
| Carbon tetrabromide | 4 g |

A mixture comprising the above components was dispersed and emulsified in 500 g of ion-exchanged water containing 6 g of a nonionic surfactant (Nonipole 400 manufactured by Sanyo Chemical Industries, Ltd.) and 10 g of an anionic surfactant (Neogen R (sodium dodecylbenzenesulfonate) manufactured by Daiichi Kogyo Seiyaku Co., Ltd.) in a flask, which was then gently stirred for 10 minutes and, while being stirred, was admixed with 50 g of ion-exchanged water containing 4 g of ammonium persulfate and thereafter the atmosphere of the flask was replaced with a nitrogen gas. The contents were continuously stirred and were heated to 70° C. by means of an oil bath, and the emulsion polymerization was continued in this state for 6 hours.

In the above-described way, there was prepared a dispersion liquid of resin particles (1) which had an average particle diameter of 150 nm and which were made up a resin having a glass transition point of 58° C. and a weight average molecular weight (Mw) of 20,000.

Preparation of a Dispersion Liquid of Resin Particles (2)

| | |
|---|---|
| Styrene | 280 g |
| n-butyl acrylate | 120 g |
| Acrylic acid | 8 g |

A mixture comprising the above components was dispersed and emulsified in 550 g of ion-exchanged water containing 6 g of a nonionic surfactant (Nonipole 400 manufactured by Sanyo Chemical Industries, Ltd.) and 12 g of an anionic surfactant (Neogen R manufactured by Daiichi Kogyo Seiyaku Co., Ltd.) in a flask, which was then gently stirred for 10 minutes and, while being stirred, was admixed with 50 g of ion-exchanged water containing 2 g of ammonium persulfate and thereafter the atmosphere of the flask was replaced with a nitrogen gas. The contents were continuously stirred and were heated to 70° C. by means of an oil bath, and the emulsion polymerization was continued in this state for 5 hours.

In the above-described way, there was prepared a dispersion liquid of resin particles (2) which had an average particle diameter of 95 nm and which were made up a resin having a glass transition point of 51° C. and a weight average molecular weight (Mw) of 700,000.

Preparation of a Dispersion Liquid Comprising colorant Particles (1)

| | |
|---|---|
| Carbon black (Morgal L manufactured by Cabot corporation) | 50 g |
| Anionic surfactant (Neogen R manufactured by Daiichi Kogyo Seiyaku Co., Ltd.) | 5 g |
| Ion-exchanged water | 200 g |

A mixture of above components was dispersed by means of an ultrasonic wave disperser for 20 minutes, and a dispersion liquid comprising colorant (carbon black) particles (1) having a medium particle diameter of 160 nm was prepared.

Preparation of a Dispersion Liquid Comprising Release Agent Particles (1)

| | |
|---|---|
| Paraffin wax (HNP0190, having a melting point of 85° C. and manufactured by Nippon Seiro Co., Ltd.) | 50 g |
| Cationic surfactant (Sanizole B50 manutactured by Kao Corporation) | 7.5 g |
| Ion-exchanged water | 200 g |

A mixture of above components was heated to 95° C. The mixture was dispersed by means of a homogenizer (Ultratalax T50 manufactured by IKA Co., Ltd.) and was further dispersed by means of a pressure-ejection type homogenizer. In this way, a dispersion liquid comprising release agent (paraffin wax) particles (1) having an average particle diameter of 250 nm was prepared.

Preparation of Flocculated Particles

| | |
|---|---|
| Dispersion liquid of resin particles (1) | 120 g |
| Dispersion liquid of resin particles (2) | 80 g |
| Dispersion liquid of colorant particles (1) | 30 g |
| Dispersion liquidof release agent particles (1) | 40 g |
| Cationic surfactant (Sanizole B50 manufactured by Kao Corporation) | 1.5 g |
| Ion-exchanged water | 600 g |

A mixture of the above components was placed in a round stainless steel flask (having an inner diameter of 160 mm and a depth of 180 mm). The depth of the liquid including bubbles in the flask was 120 mm. The contents were heated to 48° C. by means of an oil bath while the contents were stirred by means of a stainless steel single-flat plate blade (having a blade diameter of 85 mm and a width of 65 mm in the direction of the depth of liquid) as illustrated in FIG. 1, and were then kept at 48° C. for 30 minutes. The results of the observation by means of an optical microscope confirmed the formation of flocculated particles having an average particle diameter of about 5.4 $\mu$m (volume: 80 $cm^3$).

A Second Step

Preparation of Adhered Particles

Then, to the above prepared dispersion liquid of flocculated particles was gently added 60 g of the dispersion liquid of resin particles (1) as a dispersion of resin fine particles, which contained 22 $cm^3$ of the resin fine particles. In this step, the blend of the dispersion liquid of flocculated particles and the dispersion liquid of resin particles (1) was stirred by means of the same blade as in the first step. The temperature of the oil bath for heating the blend was kept at 50° C. for 1 hour.

The results of the observation by means of an optical microscope confirmed the formation of adhered particles having an average particle diameter of about 5.9 μm.

A Third Step

After that, to the above prepared dispersion liquid kept at 50° C. was added 5 g of an anionic surfactant (Neogen R manufactured by Daiichi Kogyo Seiyaku Co., Ltd.). Then, the contents were heated to 95° C., and were held at that temperature for 5 hours.

The contents were then cooled down, and the reaction product was filtered, washed sufficiently with ion-exchanged water and dried by means of a vacuum drier. In this way, toner for developing an electrostatic image was obtained.

Evaluation

The average particle diameter of the thus obtained toner for developing an electrostatic image was measured by means of a Coulter counter, and a value of 6.0 μm was obtained. The volume average particle size distribution index (GSDv) was 1.23; the number average particle size distribution index (GSDp) was 1.28; and the ratio of the volume average particle size distribution index (GSDv) to the number average particle size distribution index (GSDp) , i.e., (GSDv)/(GSDp), was 0.96.

According to the results of the observation by means of an electron microscope of the surface state of the toner for developing an electrostatic image, the exposure of a wax substance on the surface of the toner particle was very slight and no free wax substance was found. The fixing quality of the toner was evaluated with a modified version of a V500 copying machine (manufactured by Fuji Xerox Co., Ltd.) and a durability tester utilizing abrasion of a waste cloth. Fixability was satisfactory at a heat roll temperature of 125° C., and no offset was observed up to 210° C.

Preparation of an Electrostatic Images Developer

The obtained toner was weighed into a glass bottle such that a toner concentration was 5% by weight for ferrite carrier (resin-coated carrier) which had an average particle diameter of 50 μm and was coated with 1% of polymethyl methacrylate (manufactured by Soken Chemical Engineering Co., Ltd.), and thereafter the toner and the carrier were mixed for 5 minutes in a ball mill and a two-component developer was obtained.

The electrostatic charge amount of the developer was measured by means of a blow-off charge amount tester (manufactured by Toshiba Corporation). The charge amount was found to be 22 μC/g, which was sufficient. The quality of the developer was evaluated with a modified version of a V500 copying machine (manufactured by Fuji Xerox Co., Ltd.), wherein a continuous copying test to copy on 50,000 sheets of paper was performed. Images were formed stably even after taking 50,000 copies, and toner consumption was small.

Comparative Example 1

Preparation of Flocculated Particles

The procedure of the step 1 of Example 1 was repeated except that the blade for stirring as used therein was replaced with a stainless steel single-flat plate blade (having a blade diameter of 85 mm and a width of 40 mm in the direction of the depth of liquid). After the first step, the formation of flocculated particles having an average particle diameter of about 5.2 μm was confirmed.

Preparation of Adhered Particles

Then, to the above prepared dispersion of flocculated particles was gently added 60 g of the dispersion liquid of resin particles (1) as a dispersion of resin fine particles, which contained 22 $cm^3$ of the resin fine particles. In this step, the blend of the dispersion of flocculated particles and the dispersion liquid of resin particles (1) was stirred by means of the same blade as in the first step. The temperature of the oil bath for heating the blend was kept at 50° C. for 1 hour.

The results of the observation by means of an optical microscope confirmed the formation of adhered particles having an average particle diameter of about 5.7 μm.

After that, to the above prepared dispersion liquid kept at 50° C. was added 5 g of an anionic surfactant (Neogen R manufactured by Daiichi Kogyo Seiyaku Co., Ltd.). Then, the contents were heated to 95° C., and were held at that temperature for 5 hours.

The contents were then cooled down, and the reaction product was filtered, washed sufficiently with ion-exchanged water and dried by means of a vacuum drier. In this way, toner for developing an electrostatic image was obtained.

Evaluation

The average particle diameter of the thus obtained toner for developing an electrostatic image was measured by means of a Coulter counter, and a value of 5.9 μm was obtained. The volume average particle size distribution index (GSDv) was 1.26; the number average particle size distribution index (GSDp) was 1.34; and the ratio of the volume average particle size distribution index (GSDv) to the number average particle size distribution index (GSDp) , i.e., (GSDv)/(GSDp), was 0.94.

Preparation of an Electrostatic Images Developer

The obtained toner was weighed into a glass bottle such that the toner concentration was 5% by weight for ferrite carrier (resin-coated carrier) which had an average particle diameter of 50 μm and was coated with 1% of polymethyl methacrylate (manufactured by Soken Chemical Engineering Co., Ltd.), and thereafter the toner and the carrier were mixed for 5 minutes in a ball mill and a two-component developer was obtained.

The electrostatic charge amount of the developer was measured by means of a blow-off charge amount tester (manufactured by Toshiba Corporation). The charge amount was found to be 20 μC/g, which was sufficient. The quality of the developer was evaluated with a modified version of V500 copying machine (manufactured by Fuji Xerox Co., Ltd.), wherein a continuous copying test to copy on 50,000 sheets of paper was performanced. Until 30,000 copies, images were formed stably, and toner consumption was small. However, after 30,000 copies, background fog became increasingly remarkable, and toner consumption increased. The copying test was stopped when 42,000 copies were taken because of low density of image and serious background fog.

Comparative Example 2

The procedures of the steps 1 to 3 of Example 1 were repeated except that the blade for stirring as used therein was replaced with a stainless steel single-flat plate blade (having a blade diameter of 60 mm and a width of 30 mm in the direction of the depth of liquid).

The average particle diameter of the thus obtained toner for developing an electrostatic image was measured by means of a Coulter counter, and a value of 5.5 μm was obtained. The volume average particle size distribution index (GSDv) was 1.32; the number average particle size distribution index (GSDp) was 1.38; and the ratio of the volume average particle size distribution index (GSDv) to the number average particle size distribution index (GSDp), i.e., (GSDv)/(GSDp), was 0.96.

A two-component developer containg the obtained toner was then prepared by the same way as in Comparative Example 1. The electrostatic charge amount of the developer was measured by means of a blow-off charge amount tester (manufactured by Toshiba Corporation). The charge amount was found to be 25 $\mu$C/g, which was sufficient. The quality of the developer was evaluated with a modified version of V500 copying machine (manufactured by Fuji Xerox Co., Ltd.), wherein a continuous copying test to copy on 50,000 sheets of paper was performed. Until 20,000 copies, images were formed stably, and toner consumption was small. However, after 20,000 copies, background fog became increasingly remarkable, and toner consumption increased. The copying test was stopped when 35,000 copies were taken because of low density of image and serious background fog.

Comparative Example 3

The procedures of the steps 1 to 3 of Example 1 were repeated except that the blade for stirring as used therein was replaced with a stainless steel single-flat plate blade (having a blade diameter of 85 mm and a width of 20 mm in the direction of the depth of liquid).

The average particle diameter of the thus obtained toner for developing an electrostatic image was measured by means of a Coulter counter, and a value of 5.3 $\mu$m was obtained. The volume average particle size distribution index (GSDv) was 1.31; the number average particle size distribution index (GSDp) was 1.40; and the ratio of the volume average particle size distribution index (GSDv) to the number average particle size distribution index (GSDp), i.e., (GSDv)/(GSDp), was 0.94.

A two-component developer containing the obtained toner was then prepared by the same way as in Comparative Example 1. The electrostatic charge amount of the developer was measured by means of a blow-off charge amount tester (manufactured by Toshiba Corporation). The charge amount was found to be 24 $\mu$C/g, which was sufficient. The quality of the developer was evaluated with a modified version of v500 copying machine (manufactured by Fuji Xerox Co., Ltd.), wherein a continuous copying test to copy on 50,000 sheets of paper was performed. Until 15,000 copies, images were formed stably, and toner consumption was small. However, after 20,000 copies, background fog became increasingly remarkable, and toner consumption increased. The copying test was stopped when 25,000 copies were taken because of low density of image and serious background fog.

EXAMPLE 2

A First Step

Preparation of a Dispersion Liquid of Resin Particles (3)

| | |
|---|---|
| Styrene | 340 g |
| n-butyl acrylate | 60 g |
| Acrylic acid | 16 g |
| Dodecanethiol | 10 g |
| Carbon tetrabromide | 4 g |

A mixture comprising the above components was dispersed and emulsified in 500 g of ion-exchanged water containing 6 g of a nonionic surfactant (Nonipole 400 manufactured by Sanyo Chemical Industries, Ltd.) and 6.5 g of an anionic surfactant (Neogen R manufactured by Daiichi Kogyo Seiyaku Co., Ltd.) in a flask, which was then gently stirred for 10 minutes and, while being stirred, was admixed with 50 g of ion-exchanged water containing 4 g of ammonium persulfate and thereafter the atmosphere of the flask was replaced with a nitrogen gas. The contents were continuously stirred and were heated to 70° C. by means of an oil bath, and the emulsion polymerization was continued in this state for 6 hours. During the above-described operations, the reaction solution was treated so as not to be exposed to light that was more than necessary.

In this way, there was prepared a dispersion liquid of resin particles (3) which had an average particle diameter of 175 nm and which were made up a resin having a glass transition point of 57.5° C. and a weight average molecular weight (Mw) of 17,500.

Preparation of a Dispersion Liquid of Colorant Particles (2)

| | |
|---|---|
| Copper phthalocyanine pigment (manufactured by BASF corporation) | 100 g |
| Anionic surfactant (Neogen R manufactured by Daiichi Kogyo Seiyaku Co., Ltd.) | 15 g |
| Ion-exchanged water | 200 g |

A mixture of the above components was dispersed by means of a rotor/stator type homogenizer (Ultratalax manufactured by IKA Co., Ltd.) for 10 minutes and thereafter by means of an ultrasonic wave disperser for 20 minutes, and a dispersion liquid of colorant (cyan pigment) particles (2) having a medium particle diameter of 170 nm was prepared.

Preparation of Flocculated Particles

| | |
|---|---|
| Dispersion liquid of resin particles (3) | 120 g |
| Dispersion liquid of resin particles (2) | 80 g |
| Dispersion liquid of colorant particles (2) | 30 g |
| Cationic surfactant (Sanizole B50 manufactured by Kao Corporation) | 2.5 g |
| Ion - exchanged water | 800 g |

Figure 2:
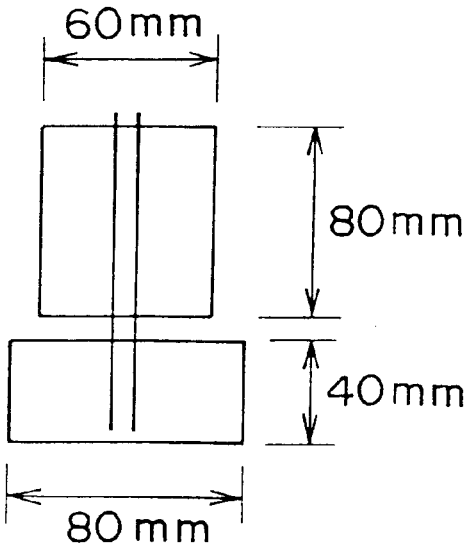
FIG. 2 is a diagram illustrating a flat plate blade (Full Zone type) as an example of a stirring means.
Figure 3:
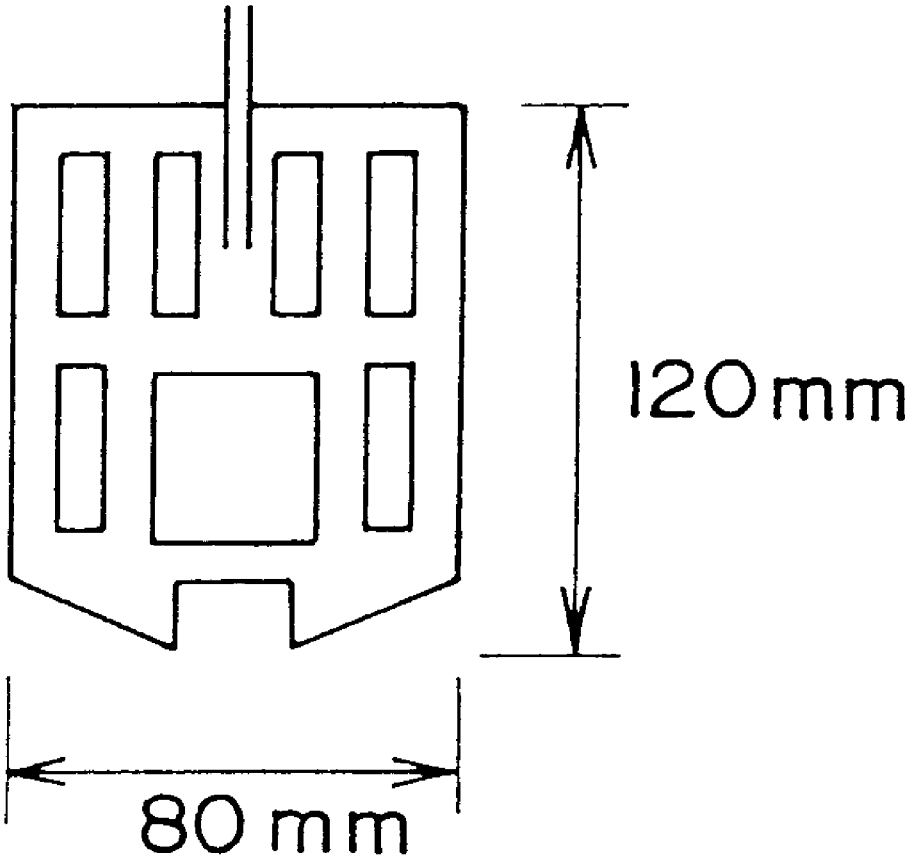
FIG. 3 is a diagram illustrating a flat plate blade (Max Blend type) as an example of a stirring means.

A mixture of the above components was placed in a round stainless steel flask (having an inner diameter of 160 mm and a depth of 180 mm). In this state, the depth of the liquid including bubbles in the flask was 140 mm. The contents were heated to 46° C. by means of an oil bath while the contents were stirred by means of stainless steel flat plate blades (Full Zone type manufactured by Shinko-Pantec Co., Ltd., comprising an upper blade having a diameter of 60 mm and a width of 80 mm in the direction of the depth of liquid together with a lower blade having a blade diameter of 80 mm and a width of 40 mm in the direction of the depth of liquid) as illustrated in FIG. 2, and were then kept at 46° C. for 30 minutes. The results of the observation by means of an optical microscope confirmed the formation of flocculated particles having an average particle diameter of about 5.0 $\mu$m (volume: 81 $cm^3$).

A Second Step

Preparation of Adhered Particles

Then, to the above prepared dispersion liquid of flocculated particles was gently added 50 g of the dispersion liquid of resin particles (3) as a dispersion of resin fine particles, which contained 20 $cm^3$ of the resin fine particles. In this step, the blend of the dispersion liquid of flocculated particles and the dispersion liquid of resin particles (3) was stirred by means of the same blade as in the first step. The temperature of the oil bath for heating the blend was kept at 48° C. for 1 hour.

The results of the observation by means of an optical microscope confirmed the formation of adhered particles having an average particle diameter of about 5.5 μm.

A Third Step

After that, to the above prepared dispersion liquid kept at 48° C. was added 5 g of an anionic surfactant (Neogen R manufactured by Daiichi Kogyo Seiyaku Co., Ltd.). Then, the contents were heated to 95° C., and were held at that temperature for 5 hours.

The contents were then cooled down, and the reaction product was filtered, washed sufficiently with ion-exchanged water and dried by means of a vacuum drier. In this way, toner for developing an electrostatic image was obtained.

Evaluation

The average particle diameter of the thus obtained toner was measured by means of a Coulter counter, and a value of 5.5 μm was obtained. The volume average particle size distribution index (GSDv) was 1.21; the number average particle size distribution index (GSDp) was 1.25; and the ratio of the volume average particle size distribution index (GSDv) to the number average particle size distribution index (GSDp), i.e., (GSDv)/(GSDp), was 0.97.

According to the results of the observation by means of an electron microscope of the surface state of the toner, the exposure of a waxy substance on the surface of the toner particle was very slight and no free wax substance was found. The fixing quality of the toner was evaluated with a modified version of V500 copying machine (manufactured by Fuji Xerox Co., Ltd.) and a durability tester utilizing abrasion of a waste cloth. Fixability was satisfactory at a heat roll temperature of 135° C., and no offset was observed up to 210° C.

Preparation of an Electrostatic Images Developer

The obtained toner was weighed into a glass bottle such that the toner concentration was 5% by weight for the same resin-coated carrier as in Example 1, and thereafter the toner and the carrier were mixed for 5 minutes in a ball mill and a two-component developer was obtained.

The quality of the developer was evaluated with a copying machine which was modified into a toner-recycling type, wherein a continuous copying test to copy on 50,000 sheets of paper was performed. Even after taking 50,000 copies, images were formed stably and vivid cyan images were still obtained.

EXAMPLE 3

The procedures of the steps 1 to 3 of Example 2 were repeated except that the blade for stirring as used therein was replaced with a stainless steel flat plate blade (Max Blend type manufactured by Sumitomo Heavy Industries Ltd., having a blade diameter of 80 mm and a width of 120 mm in the direction of the depth of liquid).

As a result, the formation of flocculated particles having an average particle diameter of about 5.2 μm was confirmed after the first step. Further, the formation of adhered particles having an average particle diameter of about 5.6 μm was confirmed after the second step.

Evaluation

The average particle diameter of the thus obtained toner for developing was measured by means of a Coulter counter, and a value of 5.7 μm was obtained. The volume average particle size distribution index (GSDv) was 1.22; the number average particle size distribution index (GSDp) was 1.24; and the ratio of the volume average particle size distribution index (GSDv) to the number average particle size distribution index (GSDp) i.e., (GSDv)/(GSDp), was 0.98.

According to the results of the observation by means of an electron microscope of the surface state of the toner, the exposure of a wax substance on the surface of the toner particle was very slight and no free wax substance was found.

Preparation of an Electrostatic Images Developer

The obtained toner was weighed into a glass bottle such that the toner concentration was 5% by weight for the same resin-coated carrier as in Example 1, and thereafter the toner and the carrier were mixed for 5 minutes in a ball mill and a two-component developer was obtained.

The quality of the developer was evaluated with a copying machine which was modified into a toner-recycling type, wherein a continuous copying test to copy on 50,000 sheets of paper was performed. As in Example 2, even after taking 50,000 copies, images were formed stably and vivid cyan images were still obtained.

What is claimed is:

1. A toner for developing electrostatic images, said toner having a volume average particle size distribution index (GSDv) of 1.3 or less, and a ratio of the volume average particle size distribution index (GSDv) to a number average particle size distribution index (GSDp), i.e., (GSDv/GSDp), of 0.95 or more.

2. A toner for developing electrostatic images according to claim 1, wherein the toner is produced by a method comprising steps of preparing a dispersion liquid of flocculated particles by forming the flocculated particles in a dispersion liquid containing at least resin particles dispersed therein, forming adhered particles by admixing a liquid dispersion comprising fine particles dispersed therein with the dispersion liquid of the flocculated particles so that the fine particles adhere to the flocculated particles, and forming toner particles by heating the adhered particles so that the fine particles fuse into the flocculated particles.

3. A method of producing toner for developing electrostatic images, said method comprising steps of preparing a dispersion liquid of flocculated particles by forming the flocculated particles in a dispersion liquid containing at least resin particles dispersed therein, forming adhered particles by admixing a liquid dispersion comprising fine particles dispersed therein with the dispersion liquid of the flocculated particles so that the fine particles adhere to the flocculated particles, and forming toner particles by heating the adhered particle so that the fine particles fuse into the flocculated particles, wherein the toner thus obtained has a volume average particle size distribution index (GSDv) of 1.3 or less, and a ratio of the volume average particle size distribution index (GSDv) to a number average particle size distribution index (GSDp), i.e., (GSDv/GSDp), of 0.95 or more.

4. A method of producing toner for developing electrostatic images according to claim 3, wherein the step of preparing the dispersion liquid of flocculated particles and the step of forming adhered particles are carried out by use of a stirring means comprising a stirring blade whose width is not smaller than one half of the depth of the liquid.

5. A method of producing toner for developing electrostatic images according to claim 4, wherein the diameter of the stirring blade of the stirring means is not smaller than one third of the diameter of the liquid.

6. A method of producing toner for developing electrostatic images according to claim 4, wherein the stirring blade of the stirring means is a flat plate blade.

7. A method of producing toner for developing electrostatic images according to claim 3, wherein the flocculated particles contain at least one selected from the group consisting of a colorant and a release agent.

8. A method of producing toner for developing electrostatic images according to claim 3, wherein the fine particles contain at least one selected from the group consisting of a colorant and a release agent.

9. A method of producing toner for developing electrostatic images according to claim 3, wherein the average particle diameter of the resin particles is 1 $\mu$m or less.

10. A method of producing toner for developing electrostatic images according to claim 3, wherein the average particle diameter of the fine particles is 1 $\mu$m or less.

11. A method of producing toner for developing electrostatic images according to claim 3, wherein the volume of the fine particles is 50% or less based on the volume of the toner particles.

12. A method of producing toner for developing electrostatic images according to claim 7, wherein the colorant is in the form of particles whose medium particle diameters are 0.5 $\mu$m or less.

13. A method of producing toner for developing electrostatic images according to claim 8, wherein the colorant is in the form of particles whose medium particle diameters are 0.5 $\mu$m or less.

14. An electrostatic image developing agent comprising a carrier and a toner, said toner having a volume average particle size distribution index (GSDv) of 1.3 or less, and a ratio of the volume average particle size distribution index (GSDv) to a number average particle size distribution index (GSDp), i.e., (GSDv/GSDp), of 0.95 or more.

15. An electrostatic image developing agent according to claim 14, wherein the toner is produced by a method comprising steps of preparing a dispersion liquid of flocculated particles by forming the flocculated particles in a dispersion liquid containing at least resin particles dispersed therein, forming adhered particles by admixing a liquid dispersion comprising fine particles dispersed therein with the dispersion liquid of the flocculated particles so that the fine particles adhere to the flocculated particles, and forming toner particles by heating the adhered particles so that the fine particles fuse into the flocculated particles.

* * * * *